US010472797B2

(12) United States Patent
Park

(10) Patent No.: US 10,472,797 B2
(45) Date of Patent: Nov. 12, 2019

(54) TWO STEP HYDRAULIC BREAKER WITH AUTOMATIC STROKE ADJUSTMENT

(71) Applicant: Daemo Engineering Co., Ltd., Siheung-si (KR)

(72) Inventor: Yong Shik Park, Siheung-si (KR)

(73) Assignee: DAEMO Engineering Co., Ltd., Siheung-Si (KR)

( * ) Notice: Subject to any disclaimer, the term of this patent is extended or adjusted under 35 U.S.C. 154(b) by 0 days.

(21) Appl. No.: 15/382,742

(22) Filed: Dec. 19, 2016

(65) Prior Publication Data

US 2018/0163366 A1 Jun. 14, 2018

(30) Foreign Application Priority Data

Dec. 13, 2016 (KR) ..... 10-2016-0169952

(51) Int. Cl.

| | |
|---|---|
| ***E02F 3/84*** | (2006.01) |
| ***E02F 5/30*** | (2006.01) |
| ***E02F 3/96*** | (2006.01) |
| ***E02D 7/10*** | (2006.01) |
| *B21J 7/24* | (2006.01) |
| *B21J 7/28* | (2006.01) |

(52) U.S. Cl.

CPC ..... *E02F 3/84* (2013.01); *E02D 7/10* (2013.01); *E02F 3/966* (2013.01); *E02F 5/305* (2013.01); *B21J 7/24* (2013.01); *B21J 7/28* (2013.01)

(58) Field of Classification Search

CPC ... B25D 9/12; B25D 9/14; B25D 9/26; B25D 9/125; B25D 9/145; B25D 2250/221; F15B 9/08; F15B 9/2221; E21B 4/14; E21B 6/00; B21J 7/24; B21J 7/28; E02F 3/84

USPC ..... 173/206, 207, 208; 91/218–354; 251/318, 319, 324

See application file for complete search history.

(56) References Cited

U.S. PATENT DOCUMENTS 4,179,983 A * 12/1979 Wallace ..... F01B 11/02 173/208
4,380,901 A * 4/1983 Rautimo ..... B25D 9/12 60/418

(Continued)

FOREIGN PATENT DOCUMENTS

JP 2013233595 A * 11/2013 ..... B25D 9/04
KR 10-1138987 4/2012

(Continued)

*Primary Examiner* — Alexander M Valvis
*Assistant Examiner* — Daniel Jeremy Leeds
(74) *Attorney, Agent, or Firm* — EIPG; Seungman Kim

(57) ABSTRACT

A two-step auto stroke hydraulic breaker includes a cylinder including a high-low pressure chamber, a high pressure chamber, and a pressure converting chamber including a pilot port, a high pressure connecting port connected to the high pressure chamber, a sensing port, an oil tank port, a long stroke port, and a short stroke port, a piston including small diameter portions, upper and lower large diameter portions, a sensing fluid groove between the upper and lower large diameter portions, and a return fluid groove formed on the lower the large diameter portion, a fluid circuit unit to control a supply direction of the fluid to the cylinder and to generate a fluid pressure to selectively change a stroke, and a chisel to break the bedrock when a lower portion of the piston descends to impact the chisel during a descending operation.

20 Claims, 10 Drawing Sheets

Sensing

(56) References Cited

U.S. PATENT DOCUMENTS

| | | | | | |
|---|---|---|---|---|---|
| 4,413,687 | A * | 11/1983 | Eklof | B25D 9/12 | 173/207 |
| 4,800,797 | A * | 1/1989 | Comarmond | B25D 9/145 | 91/307 |
| 5,884,713 | A * | 3/1999 | Shinohara | B06B 1/183 | 173/206 |
| 5,944,120 | A * | 8/1999 | Barden | B25D 9/145 | 173/135 |
| 2014/0262407 | A1* | 9/2014 | Moore | B25D 9/145 | 173/208 |
| 2016/0053908 | A1* | 2/2016 | Hamalainen | E21B 1/00 | 251/12 |
| 2016/0279775 | A1 | 9/2016 | Daemo | | |
| 2018/0207782 | A1* | 7/2018 | Koizumi | B25D 9/26 | |

FOREIGN PATENT DOCUMENTS

| | | |
|---|---|---|
| KR | 10-2015-0034071 | 4/2015 |
| KR | 10-1550899 | 9/2015 |

* cited by examiner

Long Stroke

Sensing

Short Stroke

Short Stroke → Long Stroke

Short Stroke → Long Stroke

TWO STEP HYDRAULIC BREAKER WITH AUTOMATIC STROKE ADJUSTMENT

CROSS-REFERENCE TO RELATED APPLICATION

This application claims the priority under 35 U.S.C. § 119 of Korean Patent Application No. 10-2016-0169952, filed on Dec. 13, 2018 in the Korean Intellectual Property Office, the disclosure of which is incorporated herein in its entirety by reference.

BACKGROUND

1. Field

One or more embodiments relate to a 2-step auto stroke type hydraulic breaker, and more particularly, to a 2-step auto stroke type hydraulic breaker configured to automatically change a stroke between a long stroke and a short stroke according to a strength of an object, such as a bedrock, configured to automatically sense a stroke change, and configured to stably maintain a pressure of a high pressure unit during the stroke change.

2. Description of the Related Art

Generally, a hydraulic breaker is attached to construction equipment, such as an excavator or a loader, is used for crushing or breaking an object, such as a concrete and bedrock, and includes a chisel, as a demolition tool, which descends and ascends by a fluid pressure (e.g., a hydraulic cylinder) thereof to generate an impact force to the object.

The hydraulic breaker includes a cylinder and a piston, which operate by the fluid pressure, and the chisel movably disposed in front of the cylinder to break the object.

The piston reciprocates by an operation of the cylinder to impact the chisel and thus the impact is transmitted to the object so that the object is crushed or broken.

A gas chamber is disposed in a rear portion of the cylinder, a valve apparatus is disposed on one side surface of the cylinder to control a fluid supply necessary to operate the piston, and an accumulator is disposed adjacent to the side surface of the cylinder to store a fluid to use as a kinetic energy.

The valve apparatus includes a valve housing formed on the side surface of the cylinder, a valve coupled to an inside of the valve apparatus through an opening of the valve housing to control the fluid supply, and a valve cover coupled to the valve housing through a plurality of connection members to seal the opening of the valve housing and to support a movement of the valve.

In a conventional hydraulic breaker having a constant stroke of a piston when the piston descends and ascends, a working speed is not changed according to a strength of the bedrock, and thus, there are problems that workability is lowered, for example.

Korean laid-open no.: 10-2015-0034071, dated Apr. 2, 2015, describes a stroke valve to control a hydraulic breaker, Korean patent registration no.; 10-1138987, dated Apr. 16, 2012, describes a hydraulic breaker having an automatic stroke converting function, and Korean patent registration no.: 10-1550899, dated Sep. 1, 2015, describes a hydraulic breaker having two auto strokes.

However, a pressure of a high pressure chamber disposed at an upper portion of a piston is repeatedly changed between a high pressure and a low pressure according to a sensing pressure of a conventional stroke valve, and thus, repetition of the pressure changes causes a stroke operation unstable in a hydraulic breaker which is sensitive to the pressure changes.

SUMMARY

One or more embodiments include a 2-step auto stroke type hydraulic breaker having a structure to automatically change a stroke between a long stroke and a short stroke according to an auto-sensing of strength of an object, such as a concrete or bedrock, for example.

One or more embodiments include a 2-step auto stroke type hydraulic breaker configured to automatically sense a long stroke operation and a short stroke operation according to strength of an object, such as a concrete or bedrock, for example.

One or more embodiments include a 2-step auto stroke type hydraulic breaker configured to improve stability of an auto stroke operation by maintaining a stable pressure of a high pressure chamber during the auto stroke operation which is changed according to strength of an object, such as a bedrock.

One or more embodiments include a 2-step auto stroke type hydraulic breaker configured to reduce an error in a valve conversion structure according to a piston stroke and an operation of sensing strength of the bedrock.

Additional aspects will be set forth in part in the description which follows and, in part, will be apparent from the description, or may be learned by practice of the presented embodiments.

According to one or more embodiments, a two-step auto stroke hydraulic breaker may include a cylinder including a high-low pressure chamber at an upper portion thereof, a high pressure chamber at a lower portion thereof, and a pressure converting chamber which is disposed between the high-low pressure chamber and the high pressure chamber and includes a pilot port, a high pressure connecting port connected to the high pressure chamber, a sensing port, an oil tank port, a long stroke port, and a short stroke port, a piston movably disposed inside the cylinder, and including small diameter portions corresponding to the high-low pressure chamber and the high pressure chamber, a large diameter portion disposed between the small diameter portions to correspond to the pressure converting chamber, the large diameter portion including upper and lower large diameter portions and a sensing fluid groove disposed between the upper and lower large diameter portions, a fluid circuit unit configured to control a supply direction of the fluid to the cylinder, and to generate a fluid pressure to selectively change a stroke according to fluid pressures of the pilot port, the sensing port, the long, stroke port, and the short stroke port, and a chisel configured to break the bedrock when a lower portion of the piston descends to impact the chisel during a descending operation, wherein when the sensing fluid groove of the piston is disposed to connect a high pressure connecting port of the high pressure chamber of the cylinder to the sensing port of the cylinder, the upper large diameter portion of the piston may be disposed to block the pilot port of the cylinder, and the lower large diameter portion of the piston may be disposed to block the oil tank port, the long stroke port, and the short stroke port of the cylinder.

According to one or more embodiments, when the piston descends in a normal state and a long stroke, the sensing fluid groove of the piston may not be disposed to connect the high pressure connecting port of the high pressure chamber of the cylinder to the sensing port of the cylinder. When the piston further descends from the normal state and the long stroke, the sensing fluid groove of the piston may be disposed to connect the high pressure connecting port of the high pressure chamber of the cylinder to the sensing port of the cylinder in a short stroke.

According to one or more embodiments, the hydraulic breaker may further include a return fluid groove being concave on the lower large diameter portion in a longitudinal direction of the piston, the sensing port, the high pressure connecting port, the oil tank port, the long stroke port, and the short stroke port may be disposed below the pilot port, and the high pressure connecting path may supply a fluid from the high pressure chamber to the sensing port through the sensing fluid groove.

According to one or more embodiments, the fluid circuit unit may include a control valve disposed on a plurality of fluid paths between the cylinder and a pump to control the supply direction of the fluid through the fluid paths, and a stroke converting valve including a first pressure portion connected to the sensing port through a first fluid path, a second pressure portion connected to the pilot port through a second fluid path having the fluid pressure relatively higher than the fluid pressure of the first fluid path in a normal state, and selectively connecting the control valve and a third fluid path connected to the short stroke port of the cylinder, a fourth fluid path configured to connect the long stroke port and the control valve, a bypass fluid path configured to connect the first fluid path and the second fluid path, and an orifice disposed in the bypass fluid path.

According to one or more embodiments, an area of the first pressure portion of the stroke converting valve connected to the first fluid path may be same as an area of the second pressure portion of the stroke converting valve connected to the second fluid path, the stroke converting valve may perform a closing operation of blocking the third fluid path by using the fluid pressure of the second fluid path greater than the fluid pressure of the first fluid path in the normal state, and the stroke converting valve performs an open operation of connecting the third fluid path to the control valve when the fluid pressure of the high pressure chamber is transmitted to the first fluid path through the high pressure connecting path, the sensing fluid groove, and the sending port.

According to one or more embodiments, the sensing fluid groove may be concave in a radial direction of the large diameter portion along the outer circumferential surface of the large diameter portion of the piston, and may be disposed above a middle portion of the piston so that the fluid pressure of the high pressure chamber is transmitted to the sensing port through the high pressure connecting path when the chisel breaks the bedrock.

According to one or more embodiments, the sensing port may be disposed below the pilot port, an oil tank port may be disposed below the sensing port, the long stroke port may be disposed below the oil tank port, and the short stroke port may be disposed below the long stroke port.

According to one or more embodiments, the oil tank port, the long stroke port, and the short stroke port may be formed as a groove shape on a hollow inside circumferential surface of the cylinder, and cross-sections of the pilot port and the sensing port may be disposed on a same plane perpendicular to the hollow inside circumference surface of the cylinder.

According to one or more embodiments, when the piston is at a standard piston contact point, the pilot port is sealed by the upper large diameter portion, the sensing port is sealed by the lower large diameter portion, and the oil tank port, the long stroke port, and the short stroke port are sealed by the lower large diameter portion.

According to one or more embodiments, the return fluid groove of the piston has a length corresponding to an interval between the long stroke port and the oil tank port of the cylinder, and when the return fluid groove of the piston includes one end disposed at a same height as the oil tank port of the cylinder, and the other end disposed at a same height as the long stroke port, so that the fluid is returned to the oil tank port from the long stroke port of the cylinder.

According to one or more embodiments, a two-step auto stroke hydraulic breaker, may include a cylinder including a high-low pressure chamber at an upper portion thereof, a high pressure chamber at a lower portion thereof, and a pressure converting chamber disposed between the high-low pressure chamber and the high pressure chamber and including a sensing port, a first connecting port, an oil tank port, a long stroke port, and a short stroke port, a piston movably disposed in the cylinder, and including a small diameter portion, a large diameter portion, and a sensing fluid groove being a concave shape on an outer circumferential surface of the large diameter portion of the piston, a return fluid groove being a concave shape on the large diameter portion of the piston in a longitudinal direction of the piston, a high pressure connecting path configured to supply a fluid pressure from the high pressure chamber to the sensing port, a fluid circuit unit configured to control a supply direction of a fluid supplied into an inside of the cylinder, and configured to provide the fluid pressure to selectively change a stroke according to a kind of a bedrock, and a chisel configured to break the bedrock when a lower portion of the piston descends to impact the chisel during a descending operation, wherein the fluid circuit unit may include a control valve disposed on a plurality of fluid paths between the cylinder and a pump to control the supply direction of the fluid, a stroke converting valve having an upper portion connected to a first fluid path, which is a connecting path to the sensing port, and a lower portion connected to an elastic member having an elastic force relatively greater than the fluid pressure of the first fluid path in a normal state, so that the control valve is connected to the third fluid path connected to the short stroke port of the cylinder, a fourth fluid path configured to connect the long stroke port and the control valve, a bypass fluid path configured to connect the first fluid path and a return fluid path, and an orifice disposed in the bypass fluid path.

According to one or more embodiments, the sensing fluid groove may be concave along an outer circumferential surface of the large diameter portion of piston and is disposed above a middle portion of the piston so that the fluid pressure is transmitted to the sensing port through the high pressure connecting path when the chisel breaks the bedrock.

According to one or more embodiments, the oil tank port may be disposed below the sensing port, the long stroke port may be disposed below the oil tank port, and the short stroke port may be disposed below the long stroke port.

According to one or more embodiments, the stroke converting valve may perform a closing operation of blocking the third fluid path by using the elastic force of the elastic member which is greater than the fluid pressure of the first fluid path, and may perform an open operation of connecting the third fluid path to the control valve when the fluid pressure of the high pressure chamber is transmitted to the first fluid path through the high pressure connecting path and the sensing port.

According to one or more embodiments, the return fluid groove of the piston may have a length corresponding to an interval between the long stroke port and the oil tank port of the cylinder, and may further include one end disposed at a same height as the oil tank port of the cylinder, and the other end disposed at a same height as the long stroke port of the cylinder, so that the fluid is returned to the oil tank port from the long stroke port.

According to one or more embodiments, a two-step auto stroke hydraulic breaker may include a cylinder including a high-low pressure chamber at an upper portion thereof, a high pressure chamber at a lower portion thereof, and a pressure converting chamber which is disposed between the high-low pressure chamber and the high pressure chamber and includes a sensing port, a first connecting port, an oil tank port, a long stroke port, and a short stroke port, a piston movably disposed in the cylinder, and including a small diameter portion, a large diameter portion, and a sensing fluid groove formed as a concave shape on an outer circumferential surface of the large diameter portion of the piston, a return fluid groove formed as a concave groove on the large diameter portion in an axial direction of the piston, a high pressure connecting path configured to supply a fluid pressure from the high pressure chamber to the sensing port, a fluid circuit unit configured to control a supply direction of the fluid supplied into an inside of the cylinder, and configured to provide the fluid pressure to selectively change a stroke according to a kind of a bedrock, and a chisel configured to break the bedrock when a lower portion of the piston descends to impact the chisel during a descending operation, wherein the fluid circuit unit may include a control valve disposed between the cylinder and a pump to control the supply direction of the fluid, a stroke converting valve including an upper portion connected to a first fluid path, which is a connecting path to the sensing port, and a lower portion connected to an elastic member and a return fluid path through which the fluid thereof is returned to an oil tank, so that the third fluid path is selectively connected to the control valve, a fourth fluid path configured to connect the long stroke port and the control valve; and a bypass fluid path configured to connect the first fluid path and the return fluid path, and an orifice disposed in the bypass fluid path.

According to one or more embodiments, the sensing fluid groove may be concave in a radial direction of the large diameter portion along the outer circumferential surface of the large diameter portion and may be disposed above a middle portion of the piston so that the fluid pressure is transmitted to the sensing port through the high pressure connecting path when the chisel breaks the bedrock.

According to one or more embodiments, the oil tank port may be disposed below the sensing port, the long stroke port may be disposed below the oil tank port, and the short stroke port may be disposed below the long stroke port.

According to one or more embodiments, the stroke converting valve may perform a closing operation of blocking the third fluid path by using a sum of a fluid pressure of the return fluid path and the elastic force of the elastic member, and may perform an open operation of connecting the third fluid path to the control valve when the fluid pressure of the high pressure chamber is transmitted to the first fluid path through the sensing fluid groove and the sensing port.

According to one or more embodiments, the return fluid groove may Have a length corresponding to an interval between the long stroke port and the oil tank port, and may further include one end disposed at a same height as the oil tank port, and the other end disposed at a same height as the long stroke port, so that the fluid is returned to the oil tank port from the long stroke port.

BRIEF DESCRIPTION OF THE DRAWINGS

These and/or other aspects will become apparent and more readily appreciated from the following description of the embodiments, taken in conjunction with the accompanying drawings in which.

DETAILED DESCRIPTION

Figure 1:
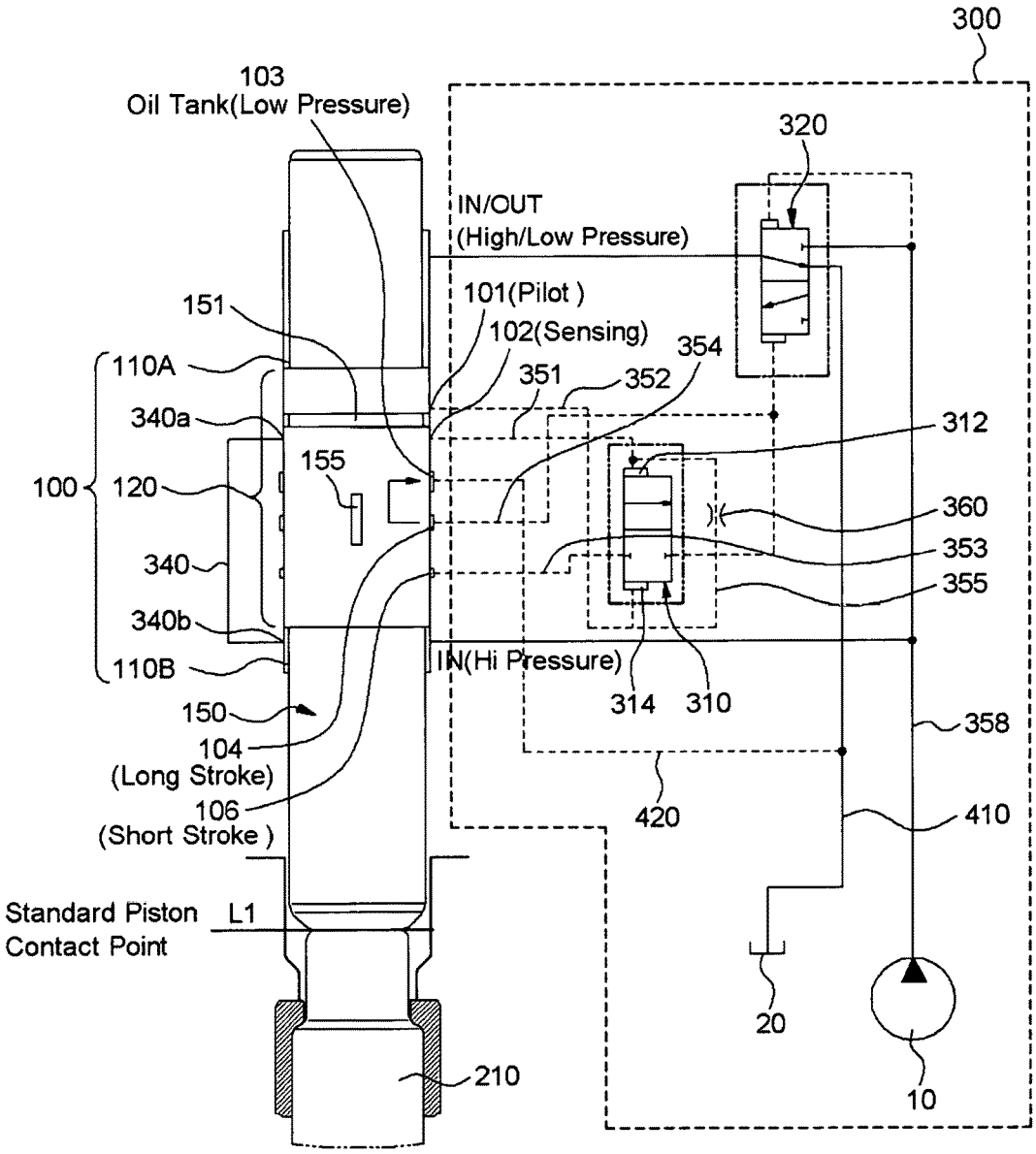
FIG. 1 is a view schematically illustrating a two-step auto stroke hydraulic breaker, according to one embodiment.

The present example embodiments may have different forms and should not be construed as being limited to the descriptions set forth herein. Accordingly, the example embodiments are merely described below, by referring to the figures, to explain aspects of the present description.

It will be understood that although the terms "first", "second", etc., may be used herein to describe various components, these components should not be limited by these terms. These components are only used to distinguish one component from another. As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

Sizes of elements in the drawings may be exaggerated for convenience of explanation. In other words, since sizes and thicknesses of components in the drawings are arbitrarily illustrated for convenience of explanation, the following embodiments are not limited thereto. When a certain example embodiment may be implemented differently, a specific process order may be performed differently from the described order. For example, two consecutively described processes may be performed substantially at the same time or performed in an order opposite to the described order.

In the following example embodiments, the x-axis, the y-axis and the z-axis are not limited to three axes of the rectangular coordinate system, and may be interpreted in a broader sense. For example, the x-axis, the y-axis, and the z-axis may be perpendicular to one another, or may represent different directions that are not perpendicular to one another.

As used herein, the term "and/or" includes any and all combinations of one or more of the associated listed items. Expressions, such as "at feast one of," when preceding a list of elements, modify the entire list of elements and do not modify the individual elements of the list.

Reference will now be made in detail to embodiments, examples of which are illustrated in the accompanying drawings, wherein like reference numerals refer to like elements throughout.

FIG. 1 illustrates a hydraulic breaker, i.e., a two-step auto stroke hydraulic breaker, according to one embodiment. Referring to FIG. 1, the hydraulic breaker may Include a cylinder 100, a piston 150, a return fluid groove 155, a high pressure connecting fluid path 340, a fluid circuit unit 300, and a chisel 210.

The cylinder 100 may include a high-low pressure chamber 110A at an upper portion thereof, a high pressure chamber 110B at a lower portion thereof, and a pressure converting, chamber 120 disposed between the high-low pressure chamber 110A and the high pressure chamber 110B and having a pressure (i.e., fluid pressure) relatively lower than the high pressure chamber 110B.

The piston 150 may be movably disposed in a hollow inside of the cylinder 100 and may include a small diameter portion 154 and a large diameter portion 152. The return fluid groove 155 may be a concave groove formed in an axial direction of the piston 150 along the large diameter portion 152.

The high pressure connecting path 340 supplies a fluid, i.e., hydraulic fluid or oil, from the high pressure chamber 110B to a sensing port 102.

The fluid circuit unit 300 may control a supply direction of the fluid to the cylinder 100 and may provide a fluid pressure to selectively change a stroke according to a kind of a bedrock. When a lower portion of the piston 150 descends to impact the chisel 210 during a descending operation, the chisel 210 may break the bedrock.

The cylinder 100 may include the high-low pressure chamber 110A, the high pressure chamber 110B, and the pressure converting chamber 120 having a pressure between a pressure of the high-low pressure chamber 110A and a pressure of the high pressure chamber 110B. The high pressure chamber 110B may be disposed at a lower portion of the cylinder 100 and may be supplied with the fluid having a high fluid pressure from a pump 10.

The high-low pressure chamber 110A may be repeatedly supplied with the fluid having the high fluid pressure and a low fluid pressure, alternately, and a minimum fluid pressure of the high-low pressure chamber 110A may be maintained higher than a fluid pressure applied to the pressure converting chamber 120 in which the sensing port 102 is disposed.

Since a pilot port 101 is disposed closer to the high pressure chamber 110A than the sensing port 102, a fluid pressure of the pilot port 101 may be maintained relatively higher than a fluid pressure of the sensing port 102.

The cylinder 100 may include the pilot port 101 disposed below the high-low pressure chamber 110A and above the pressure converting chamber 120. The sensing port 102, an oil tank port 103, a long stroke port 104, and a short stroke port 106 may be disposed below the pilot port 101 in order.

That is, the sensing port 102 may be disposed below the pilot port 101, the oil tank port 103 may be disposed below the sensing port 102, the long stroke port 104 may be disposed below the oil tank port 103, and the short stroke port 106 may be disposed below the long stroke port 104.

The oil tank port 103, the long stroke port 104, and the short stroke port 106 may be formed as a groove shape on a hollow inside circumferential surface of the cylinder 100. Cross-sections of the pilot port 101 and the sensing port 102 may be disposed on a same plane perpendicular to the hollow inside circumference surface of the cylinder 100.

Figure 2:
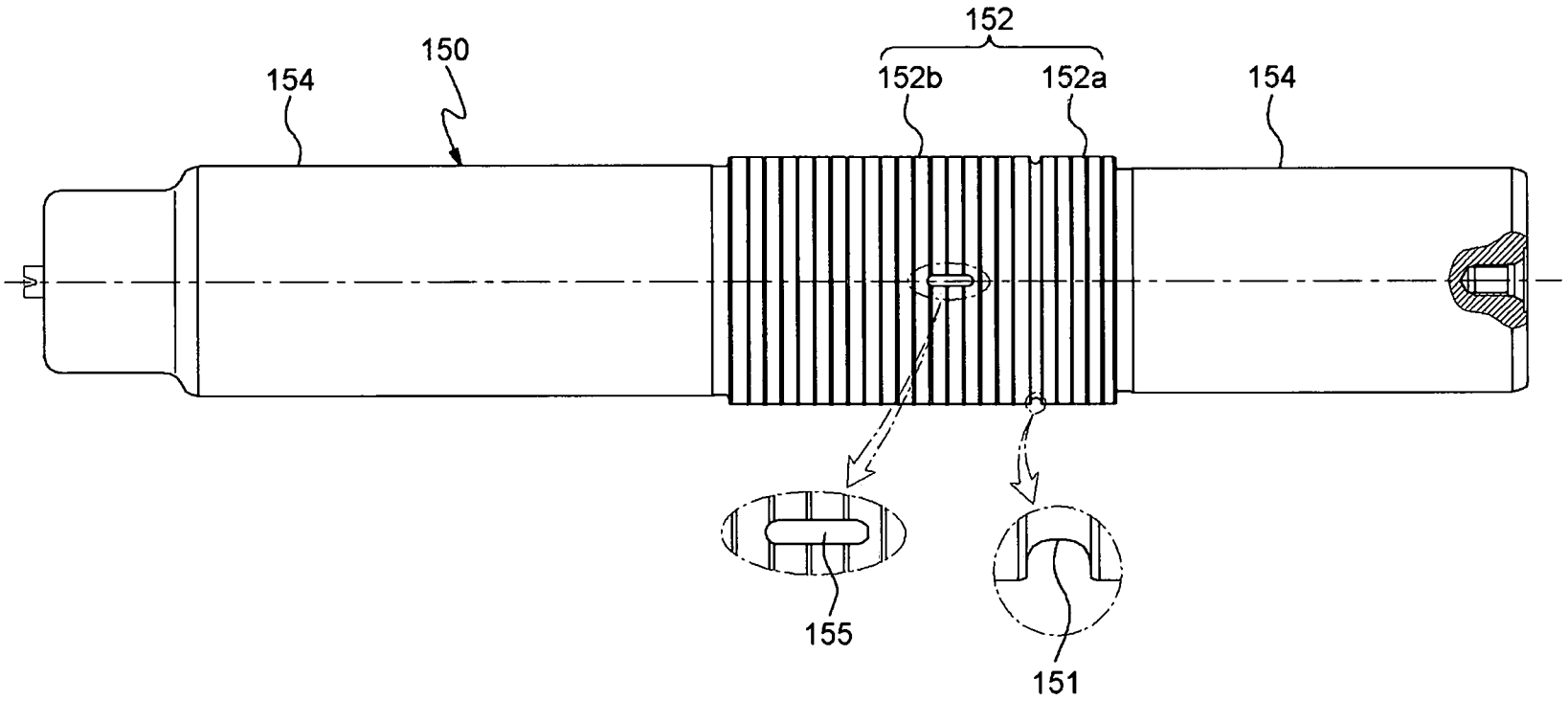
FIG. 2 is a front view schematically illustrating a piston of a two-step auto stroke hydraulic breaker according to one embodiment.

Referring to FIG. 2, the piston 150 may be disposed in an inside of the cylinder 100 to descend and ascend therein. The piston 150 may include the small diameter portion 154 and the large diameter portion 152, of which outer diameters are different from each other with respect to a longitudinal center axis of the piston 150, and a sensing fluid groove 151, which is a concave groove formed in a radial direction of the large diameter portion along an outer circumferential surface of the large diameter portion 152. The large diameter portion 152 may be divided into an upper large diameter portion 152*a* disposed above the sensing fluid groove 151 and a lower larger diameter portion 152*b* disposed below the sensing fluid groove 151.

The sensing fluid groove 151 may be concave in the radial direction of the large diameter portion 152 along an outer circumferential surface of the large diameter portion 152 and may be disposed above a middle portion of the piston 150 so that the fluid pressure of the high pressure chamber 110B is transmitted to the sensing port 102 through the high pressure connecting path 340 when the chisel 210 breaks the bedrock.

Since the sensing fluid groove 151 is concave in the radial direction of the large diameter portion 152 along an outer circumferential surface of the large diameter portion 152, the sensing fluid groove 151 may supply the fluid of the high pressure chamber 110B to the sensing port 102 through the high pressure connecting path 340, and thus a sensing structure to sense strength of the bedrock may be simplified.

The return fluid groove 155 may be formed in a concave shape on the lower large diameter portion 152*b* in a longitudinal direction (i.e., longitudinal axis direction) of the piston 150 and may have a length corresponding to an interval between the long stroke port 104 and the oil tank port 103. One end of the return fluid groove 155 is disposed at a same height as the oil tank port 101, and the other end of the return fluid groove 155 may be disposed at a same height as the long stroke port 104. Accordingly, when the piston 150 ascends and descends, the fluid, such as oil, may be returned to the oil tank port 103, and thus, when the piston 150 ascends from a bottom dead center, the above-described oil returning function operates to control the piston 150 to smoothly ascend.

The fluid circuit unit 300 may include paths (i.e., fluid paths) disposed between the cylinder 100 and the pump 10. The fluid circuit unit 300 may include a control valve 320 configured to control a supply direction of the fluid. The fluid circuit unit 300 may further include a stroke converting valve 310 which includes a first pressure portion 312 connected to the sensing port 102 through a first fluid path 351 and also include a second pressure portion 314 connected to the pilot port 101 through a second fluid path 352 having a fluid pressure relatively higher than the first fluid path 351, such that a third fluid path 353 connected to the short stroke port 106 of the cylinder 100. The fluid circuit unit 300 may further include a fourth fluid path 354 connecting the long stroke port 104 and the control valve 320, a bypass fluid path 355 connecting the first fluid path 351 and the second fluid path 352, and an orifice 360 disposed in the bypass fluid path 355.

A first return fluid path 410 is connected between the control valve 320 and a tank (oil tank or fluid tank) 20. The oil tank port 103 is connected to a second return fluid path 420 which is connected to the first return fluid path 410.

The control valve 320 includes one portion to selectively open and close a fluid supply path 358, which connects the pump 10 and the high-low pressure chamber 110A, and another portion to selectively open and close the first return fluid path 410 so that the fluid of the high-low pressure chamber 110A is returned to the tank 20.

The first fluid path 351 connects the sensing port 102 to the first pressure portion 312 of the stroke converting valve 310. When the piston 150 is in a descending operation, the sensing port 102 is connected to the high pressure connecting path 340 to transmit the fluid of the high pressure chamber 110B to the stroke converting valve 310.

The stroke converting valve 310 may be a two port and two position valve, in the stroke converting valve 310, an area of the first pressure portion 312 connected to the first fluid path 351 may be same as an area of the second pressure portion 314 connected to the second fluid path 352. The stroke converting valve performs a closing operation by a fluid pressure of the second fluid path 352 greater than a fluid pressure which is transmitted through the first fluid path 351, and also performs an open operation by a fluid pressure which is transmitted from the high pressure chamber 110B through the sensing port 102 and the first fluid path 351.

When the second pressure portion 314 of the stroke converting valve 310 is connected to the second fluid path 352 having the fluid pressure higher than the first pressure portion 312 connected to the first fluid path 351, the stroke converting valve 310 maintains a state of a long stroke operation (or long stroke position) until a higher fluid pressure is supplied from the sensing port 102 to the first pressure portion 312.

Since the above-described structure is included in the stroke converting valve 310, it may be easy to change a stroke between two step strokes. Since a short stroke operation (or a short stroke position) is performed before stalling after the bedrock is broken by the piston which further descends from a normal state, durability is improved and an error in valves thereof is reduced.

The fourth fluid path 354 connects the long stroke port 104 and the control valve 320.

The third fluid path 353 may connect the short stroke port 106 and the control valve 320 when the stroke converting valve 310 is changed, and the third fluid path 353 may join the fourth fluid path 354 at a portion of the fourth fluid path 354 disposed close to the control valve 320.

The orifice 360 may discharge the fluid disposed in the bypass fluid path 355 to an outside thereof to reduce a fluid pressure existing in an upper portion of the stroke converting valve 310, and may have a characteristic of changing a discharging period according to a diameter thereof.

Accordingly, the orifice 360 functions to reduce the fluid pressure so that the short stroke is easily changed to the long stroke.

The high pressure connecting path 340 may include a first connecting port 340*a* which is disposed at a higher portion of the high pressure connecting path 340 and disposed at a same height as the sensing port 102, and a second connecting port 340*b* which is disposed at a lower portion of the high pressure connecting path 340 and connected to the high pressure chamber 110B.

That is, since the sensing fluid groove 151 is disposed at same height as the first connecting port 340*a* when the piston 150 further descends, the high pressure connecting path 340 supplies the fluid of the high pressure chamber 110B to the sensing port 102 through the sensing fluid groove 151, and thus the fluid pressure higher than a fluid pressure supplied to the second pressure portion 314 of the stroke converting valve 310 through the second fluid path 352 is transferred to the first pressure portion 312 of the stroke converting valve 310 through the first fluid path 351.

Although the drawings illustrate the stroke converting valve 310 to have the first pressure portion 312 at an upper portion thereof and the second pressure portion 314 at a lower portion thereof, the present disclosure is not limited thereto. The first pressure portion 312 may be disposed at the lower portion and the second pressure portion 314 may be disposed at the upper portion according to a design or user preference.

A reference L1 represents a standard piston contact point which corresponds to a height where the chisel 210 and the piston 150 contact each other in a normal state.

Although not illustrated, a main body of the hydraulic breaker may include a head cap and a front head which are coupled thereto by using a long bolt.

Figure 3:
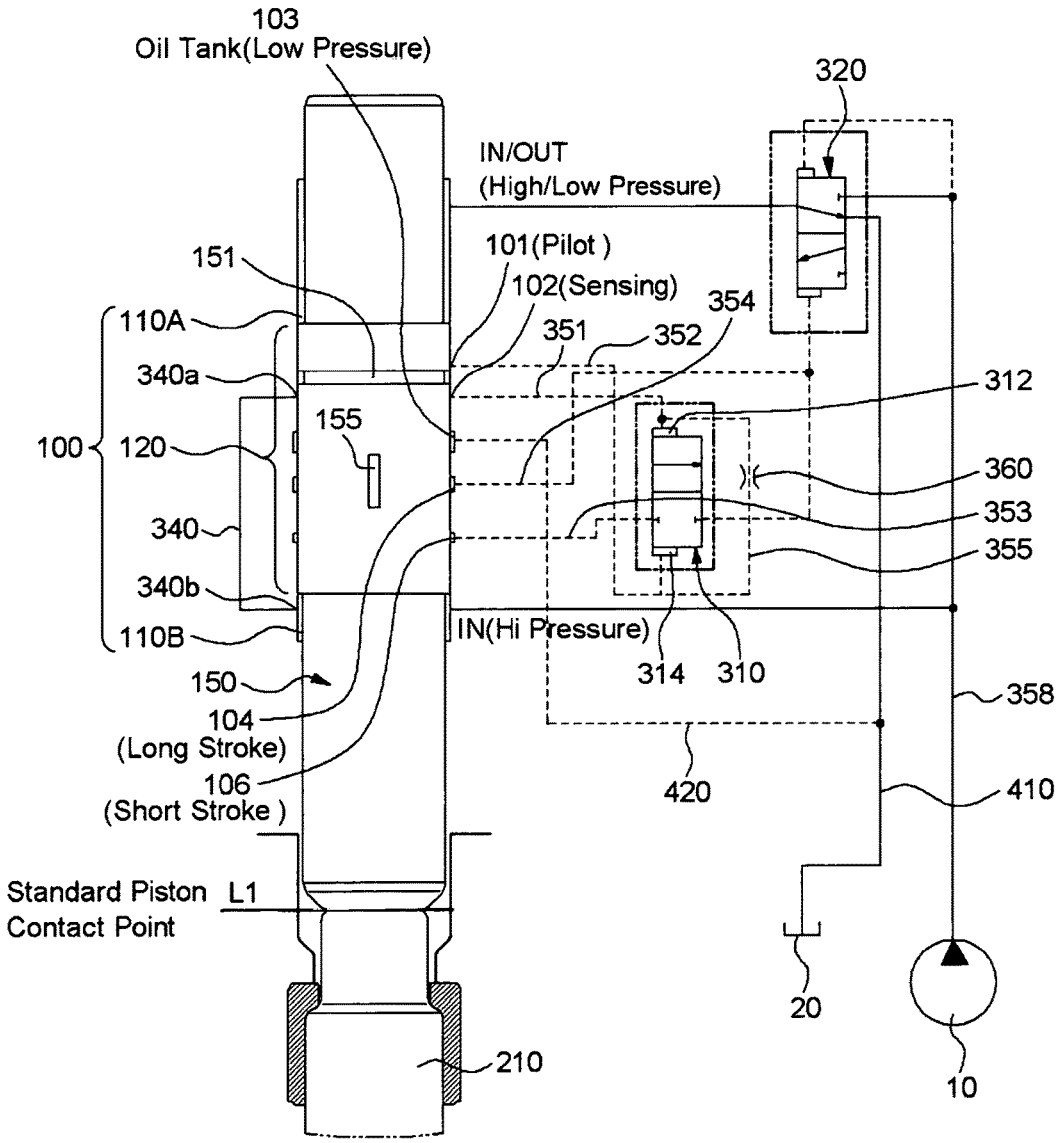
FIG. 3 is a hydraulic circuit diagram schematically illustrating a state of a two-step auto stroke hydraulic breaker before an operation of a piston therein according to one embodiment.

FIG. 3 illustrates a state of a two-step auto stroke hydraulic breaker before the piston 150 ascends. The fluid of the high pressure chamber 110B is not transferred to the sensing port 102 since the high pressure connecting path 340 is blocked by the lower large diameter portion 152*b* of the large diameter portion 152 of the piston 150, the pilot port 101 is sealed by the upper large diameter portion 152*a* of the large diameter portion 152 of the piston 150, the sensing port 102 is sealed by the lower large diameter portion 152*b* of the large diameter portion 152 of the piston 150, the fluid pressure of the second pressure portion 314 of the stroke converting valve 310 becomes higher than the fluid pressure of the first pressure portion 312, and thus the stroke converting valve 310 maintains the long stroke position.

After the piston 150 is disposed at the standard piston contact point and then further descends, the oil tank port 103, the long stroke port 104, and the short stroke port 106 may become sealed by the lower large diameter portion 152*b*.

Figure 4:
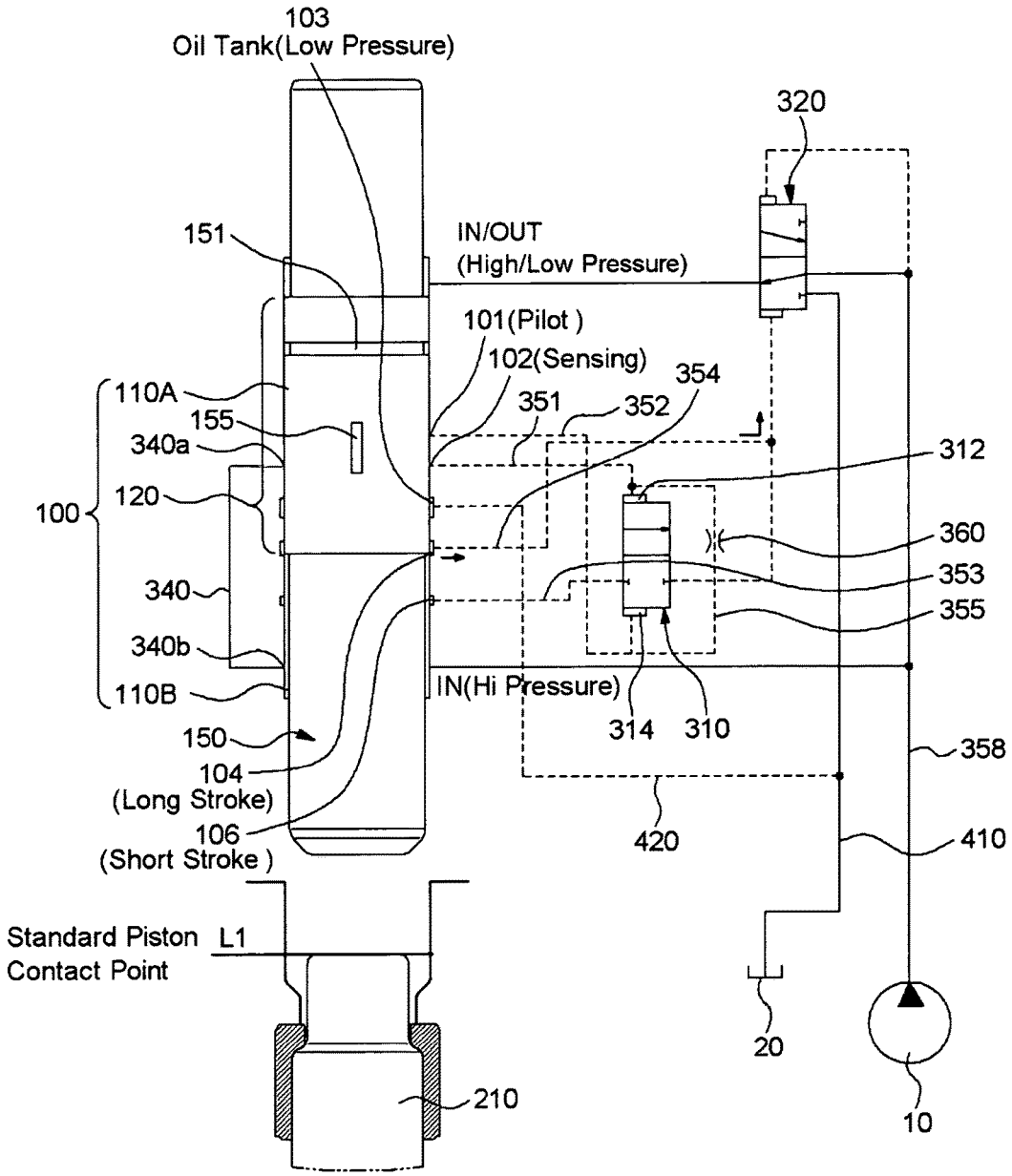
FIG. 4 is a diagram schematically illustrating a long stroke operation of a two-step auto stroke hydraulic breaker according to one embodiment.

FIG. 4 is a diagram schematically illustrating a long stroke operation of a two-step auto stroke hydraulic breaker according to one embodiment. In the long stroke operation of a bedrock-breaking operation, the fluid having a high fluid pressure is supplied from the pump 10 to the high pressure chamber 110B or the high-low pressure chamber 110A through the fluid supply path 358 and the control valve 320, the fluid of the high-low pressure chamber 110A is returned to the tank 20 through the control valve 320 and the first return fluid path 410, and the fluid of the cylinder 100 is returned to the tank 20 through the fourth fluid path 354 which is connected to the long stroke port 104, so that the piston 150 operates to have a long stroke distance (or a standard stroke distance) corresponding to the long stroke operation.

Here, since the sensing port 102 is closed, the third fluid path 353 is in a closing state, and the stroke converting valve 310 maintains a state of the long stroke positon.

When the piston 150 is at a top dead center, the pilot port 101, the sensing port 102, and the oil tank port 103 are sealed by the lower large diameter portion 152*b* to block, a fluid flow therethrough. Therefore, the long stroke port 104 is connected to the high pressure chamber 110B to transmit the fluid pressure of the high pressure chamber 110B to the control valve 320.

The high fluid pressure transmitted from the pump 10 is transmitted to the high-low pressure chamber 110A through the control valve 320 to generate a descending force applied to the piston 150.

Accordingly, when the bedrock is not broken or the bedrock has high strength, the chisel 210 applies a strong impact force to the bedrock according to the long stroke operation corresponding to the long stroke distance.

Figure 5:
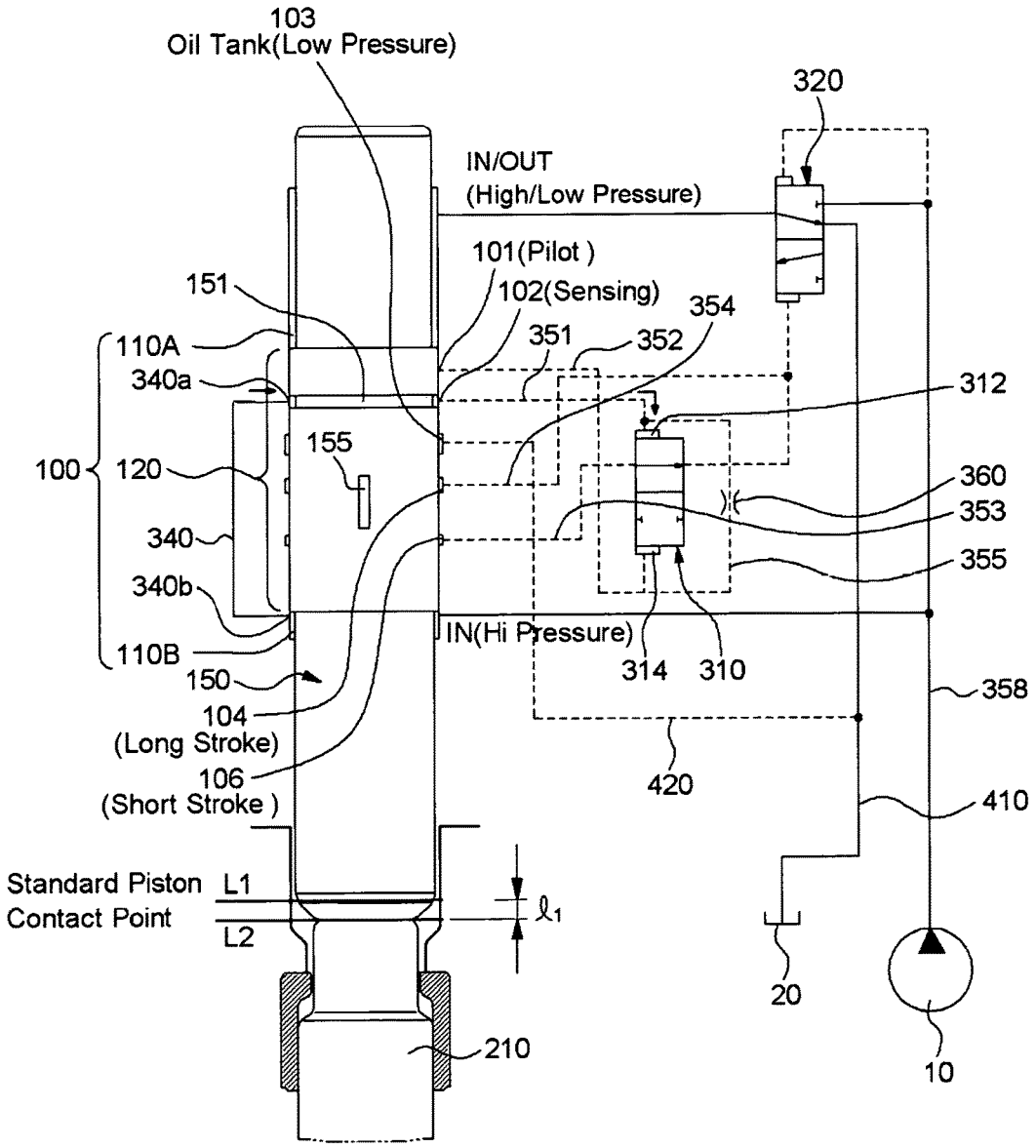
FIG. 5 is a view schematically illustrating a state of a position movement of a piston sensed when a two-step auto stroke hydraulic breaker breaks a weak bedrock, according to one embodiment.

FIG. 5 illustrates a state of a position movement of a piston 150 sensed when a two-step auto stroke hydraulic breaker breaks a weak bedrock according to one embodiment. When the bedrock is broken by the chisel 210 and the piston 150 further descends, a descending position L2 of the chisel 210 and the piston 150 is disposed lower than the standard piston contact point L1, and there is a moving gap corresponding to a difference between the descending position L2 and the standard piston contact point L1.

In this case, when the piston 150 further descends after breaking the bedrock, the sensing port 102 is connected to the high pressure connecting path 340 through the sensing fluid groove 151, the pilot port 101 is sealed by the upper large diameter portion 152*a*, and the oil tank port 103, the long stroke port 104 and the short stroke port 106 are sealed by the lower large diameter portion 152*b*. And the fluid of the high pressure chamber 110B is supplied to the first pressure portion 314 of the stroke converting valve 310 through the sensing port which is open to the high pressure connecting path 340 through the sensing fluid groove 151, and a fluid pressure of the first pressure portion 312 is higher than a fluid pressure of the second pressure portion 314 of the stroke converting valve 310, so that a position of the stroke converting valve 310 is changed and lowered to connect the third fluid path 353 to the control valve 320.

Figure 6:
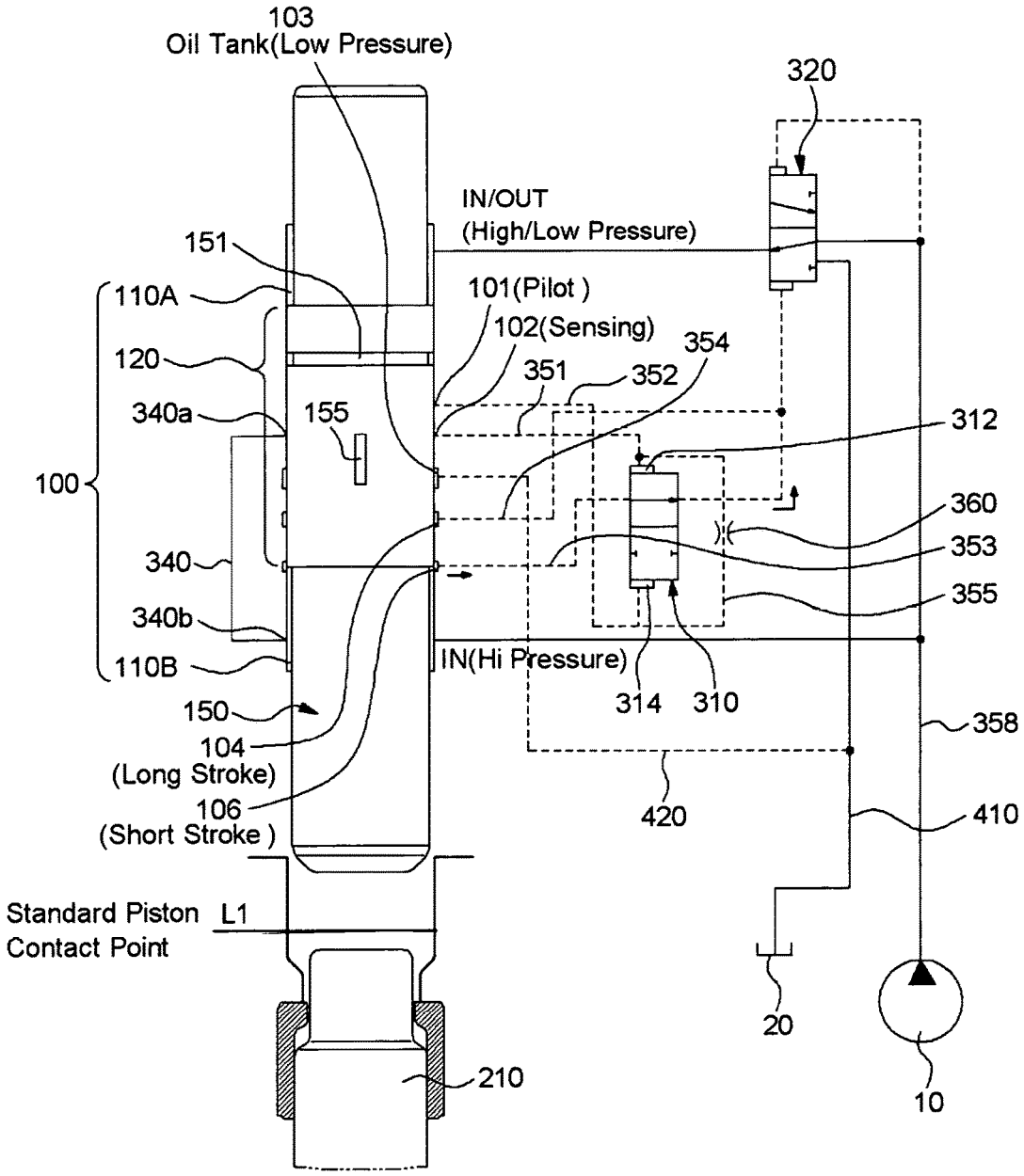
FIG. 6 is a view schematically illustrating a stroke position of a piston ascending in a short stroke of a two-step auto stroke hydraulic breaker according to one embodiment.

FIG. 6 illustrates a stroke position of a piston 150 ascending in a short stroke of a two-step auto stroke hydraulic breaker according to one embodiment. Referring to FIG. 6, the fluid of the cylinder 100 is transmitted to the control valve 320 through the third fluid path 353 and the stroke converting valve 310, and a fluid circuit is formed to selectively supply the fluid to the high-low pressure chamber 110A or the high pressure chamber 110B and to control the fluid to return to the tank 20 through the first return fluid path 410. And thus, the fluid of the cylinder 100 flows through the third fluid path 353 before the fluid of the cylinder 100 is discharged through the long stroke port 104 and the fourth fluid path 354, and, an ascending operation of the piston 150 in the short stroke operation is performed according to a flow of the fluid through the third fluid path 353.

Here, when the piston 150 is disposed at a top dead center, the pilot port 101, the sensing port 102, the oil tank port 103, and the long stroke port 104 are sealed by the lower large diameter portion 152*b*, and the short stroke port 106 is connected to the high pressure chamber 110B so that the fluid pressure of the high pressure chamber 110B is transmitted to the control valve 320.

Moreover, in the bedrock-breaking operation as described above, the fluid pressure of the high pressure chamber 110B is transmitted to the first pressure portion 312 through the sensing fluid groove 151 and the sensing port 102, so that the stroke converting valve 310 maintains the open state to connect the third fluid path 353 to the control valve 320.

The fluid pressure of the pump 10 is transmitted to the high-low pressure chamber 110A through the control valve 320, so that a descending force is applied to the piston 150 to perform the short stroke operation.

Figure 7:
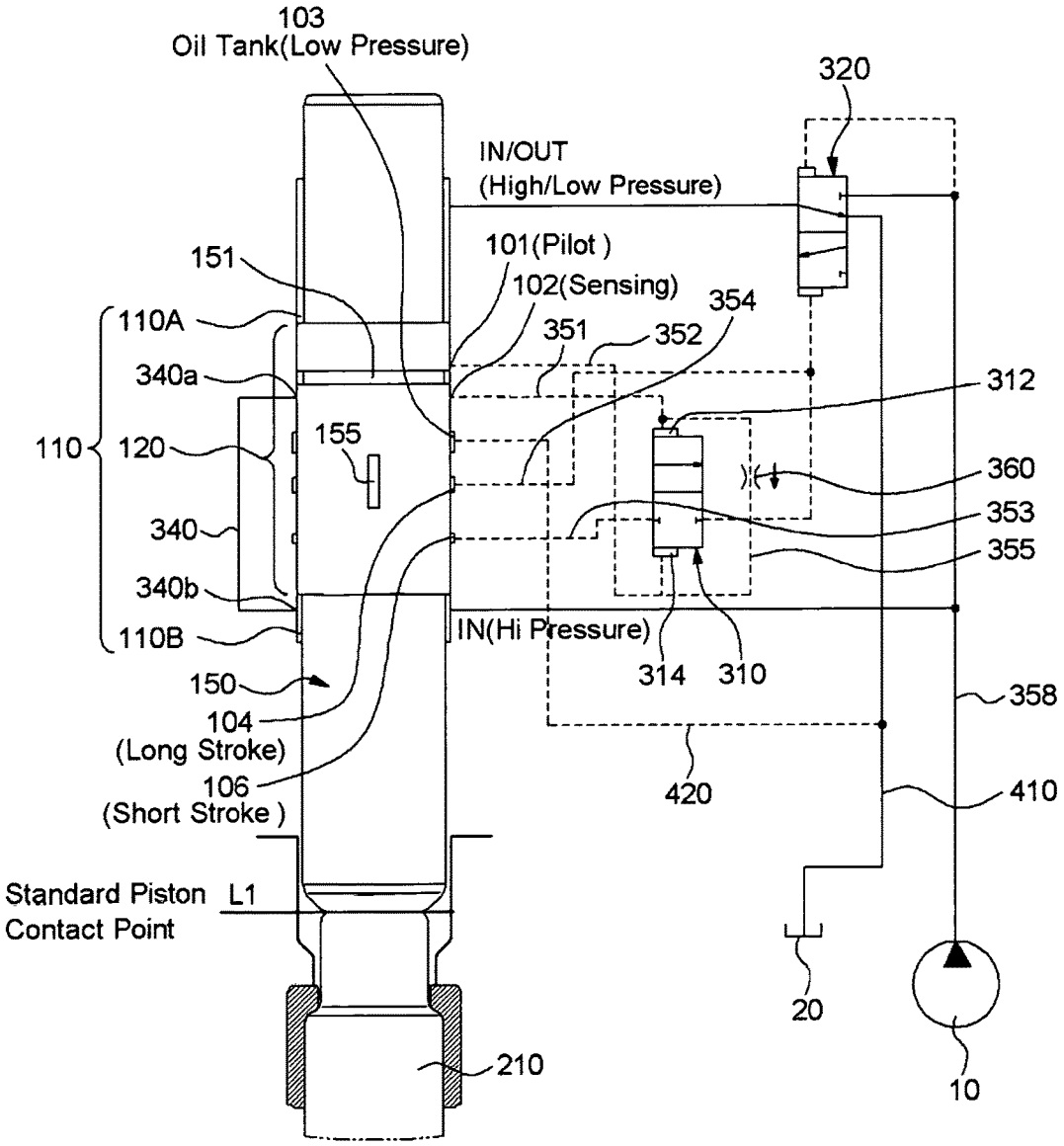
FIG. 7 is a view schematically illustrating a state of a fluid pressure of a first fluid path being released through an orifice when a short stroke is changed to a long stroke in two-step auto stroke hydraulic breaker according to one embodiment.
Figure 8:
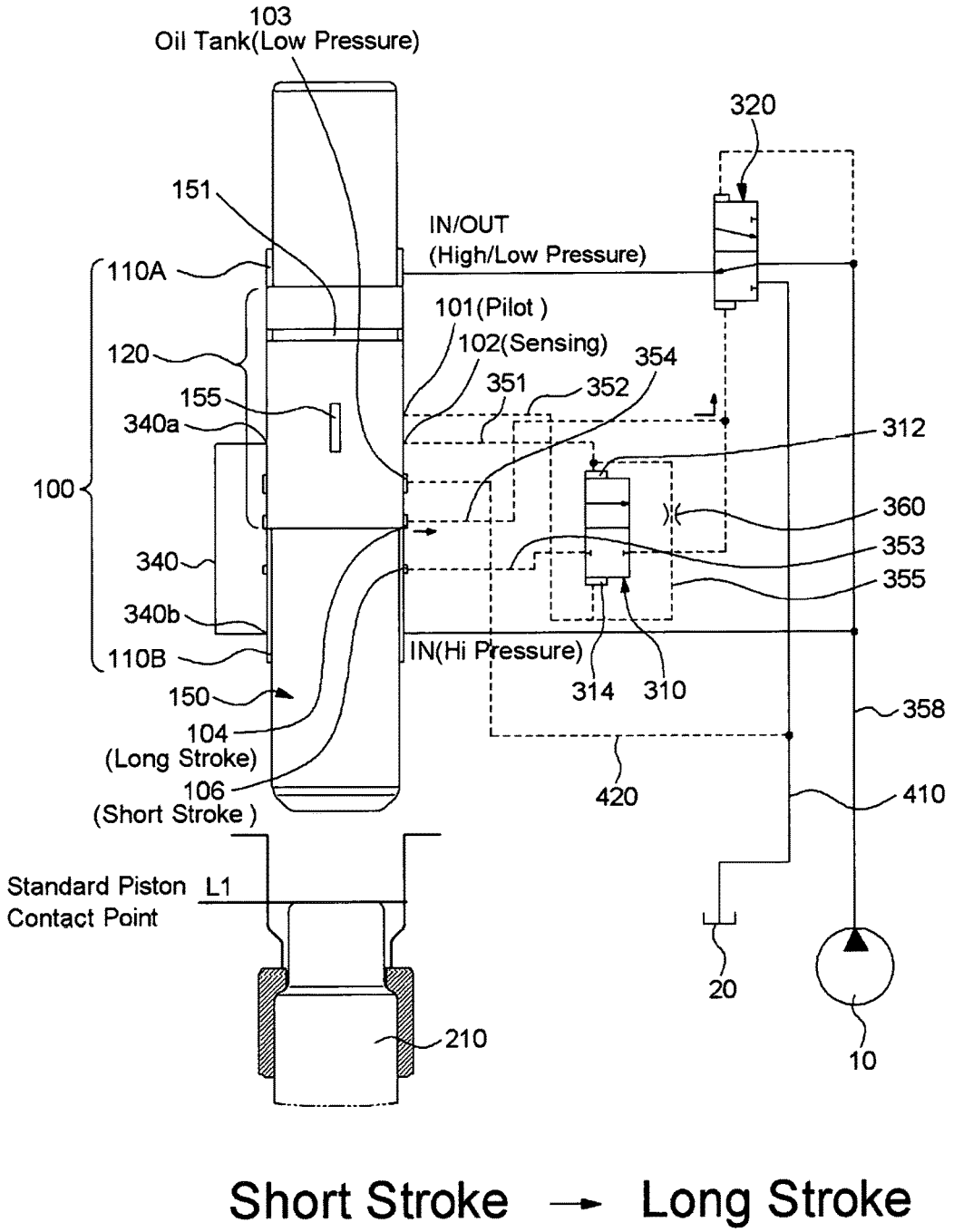
FIG. 8 is a view schematically illustrating a state of a stroke from a short stroke to a long stroke in two-step auto stroke hydraulic breaker according to one embodiment.

Meanwhile, when the piston 150 changes a stroke from an operation of breaking the weak bedrock to an operation of breaking a strong bedrock, the short stroke is changed to the long stroke as illustrated in FIG. 7. In an operation of changing the short stroke to the long stroke, after the pilot port 101 is sealed by the upper large diameter portion 152*a*, a high fluid pressure of the first fluid path 351 may be transmitted to the second fluid path 352 to reduce the high fluid pressure of the first fluid path 351 through the orifice 360 of the bypass path 355. Accordingly, since the fluid pressure transmitted to the second pressure portion 314 of the stroke converting valve 310 through the second fluid path 352 is greater than the fluid pressure supplied to the first pressure portion 312 through the first fluid path 351, the stroke converting valve 310 is changed to the long stroke position as illustrated in FIG. 4, so that the fluid of the cylinder 100 is transmitted to the control valve 320 through the long stroke port 104 and the fourth fluid path 354 in the long stroke, as illustrated in FIG. 8.

Here, when the piston 150 is at the top dead center, the pilot port 101, the sensing port 102, and the oil tank port 103 are sealed by the lower large diameter portion 152*b*, and the long stroke port 104 is connected to the high pressure chamber 110B that the fluid pressure of the high pressure chamber 1106 is transmitted to the control valve 320, as described above.

According to the present embodiment, since the strength of the bedrock is automatically sensed, and ascending and descending strokes of the piston 150 are automatically changed to the long stroke or the short stroke according to the automatically sensed strength of the bedrock. Therefore, a working speed may be improved in the short stroke. Since valve- and fluid-flow structures are configured to automatically sense the strength of the bedrock and to automatically change the strokes of the piston 150 by using the sensing fluid groove 151 and the return fluid groove 156, which are formed on the piston 150, and the high pressure connecting path 340, manufacturing processes are simplified, manufacturing costs are decreased, and errors are reduced.

Moreover, even if the fluid pressure of the high-low pressure chamber 110A is repeatedly changed between the high fluid pressure and the low fluid pressure, durability of a sensing structure, in which the high fluid pressure of the high pressure chamber 110B is transmitted to the sensing port 102 through the first connecting port 340*a* and the sensing fluid groove 151, is improved, and the above-described structures may be usable in a more sensitive hydraulic breaker.

Another embodiment will be described hereinafter and may include components same as or similar to the above-described embodiment. Therefore, like reference numerals, refer to like elements throughout, and duplicate descriptions thereof will be omitted.

Figure 9:
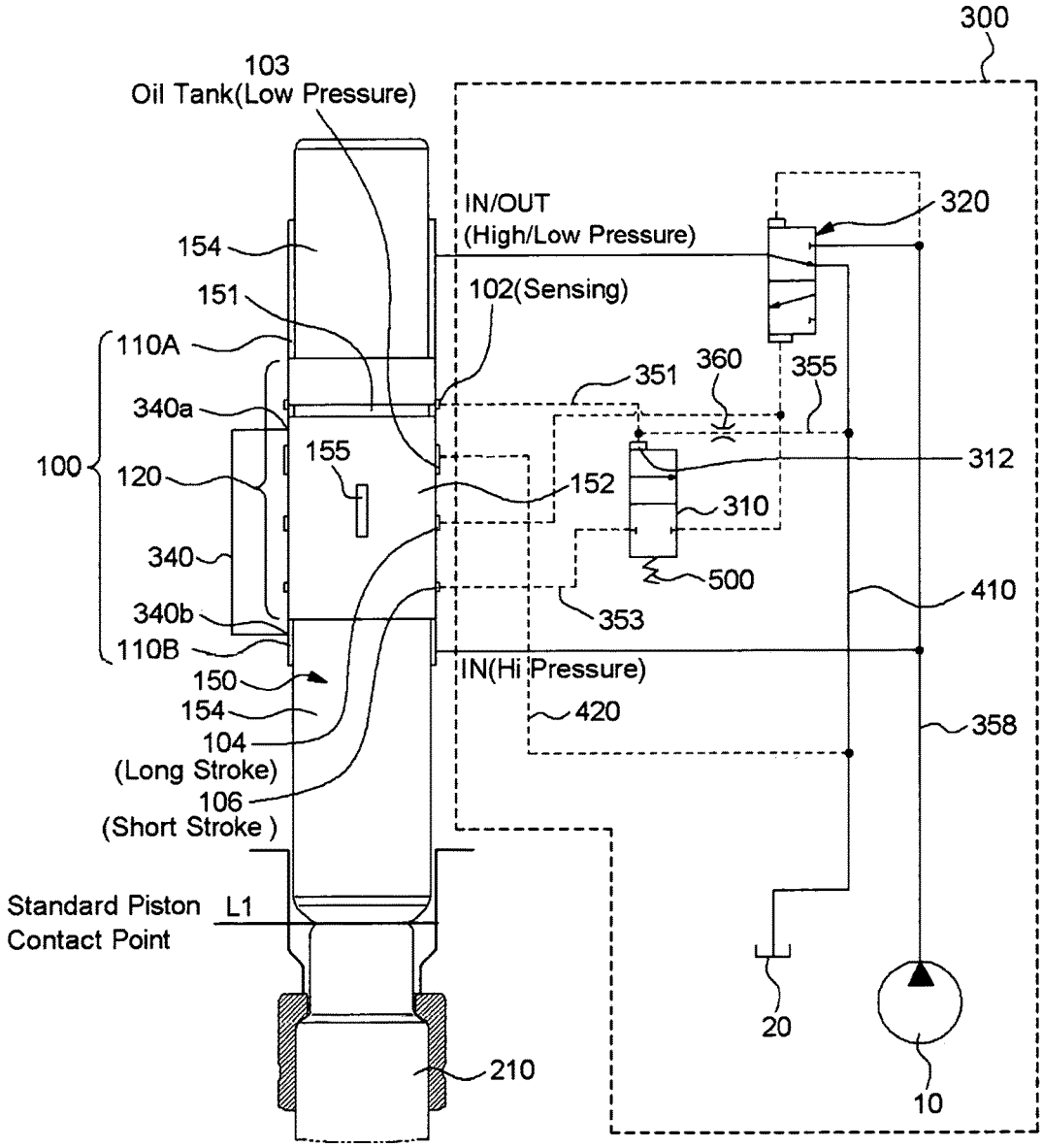
FIG. 9 is a fluid circuit diagram schematically illustrating a two-step auto stroke hydraulic breaker according to another embodiment.

FIG. 9 illustrates a two-step auto stroke hydraulic breaker according to another embodiment. Referring to FIGS. 1 and 9, the two-step auto, stroke hydraulic breaker may include the cylinder 150, which includes a high-low pressure chamber 110A at an upper portion thereof, a high pressure chamber 110B at a lower portion thereof, and a pressure converting chamber 120 disposed between the high-low pressure chamber 110A and the high pressure chamber 110B and having a pressure relatively lower than the high pressure chamber 110B, the piston 150, which is movably coupled to a hollow inside of the cylinder 100, and the sensing fluid groove 155 formed as a concave shape on the outer circumferential surface of the large diameter portion 152 of the piston 150, the return fluid groove 155, which is formed as a concave groove formed in an axial direction of the piston 150 on the large diameter portion 152, the high pressure connecting path 340, which supplies a fluid, i.e., hydraulic fluid or oil from the high pressure chamber 110B to the sensing port 102, the fluid circuit unit 300, which controls a supply direction of the fluid supplied to an inside of the cylinder 100 and provides a pressure, i.e., fluid pressure, to selectively change a stroke according to a kind of a bedrock, and the chisel 210, which breaks the bedrock when a lower portion of the piston 150 descends to impact the chisel 210 during a descending operation.

The two-step auto stroke hydraulic breaker may further include the control valve 320, which is disposed between the cylinder 100 and the pump 10 to control a supply direction of the fluid, the stroke converting valve 310, which includes an upper portion connected to the first fluid path 351, which is a connecting path of the sensing port 102, and a lower portion connected to an elastic member 500 having an elastic force, for example, tensile force, relatively greater than a pressure of the fluid supplied to the first pressure portion 312 through the first fluid path 351, the fourth fluid path 354 which connects the long stroke port 104 and the control valve 320, the bypass fluid path 355 which connects the first fluid path 351 and the first return fluid path 410, and the orifice 360 which is disposed in the bypass fluid path 355.

The two-step auto stroke hydraulic breaker of FIG. 9 does not include the pilot port 101 and the second fluid path 352 of FIG. 1. The stroke converting valve 310 includes the first pressure portion 312 supplied with the fluid pressure of the first fluid path 351, and the elastic member 500 is disposed on a portion of the stroke converting valve 310 opposite to the first pressure portion 312.

The elastic member 500 may provide an elastic force to a lower portion of the stroke converting valve 310 and maintain a long stroke position of the stroke converting valve 310 when the fluid of the high-low pressure chamber 110A is not supplied to the first pressure portion 312 of the stroke converting valve 310 through the first fluid path 351, so that a first stroke is rapidly changed to a second stroke.

The elastic force, for example, tensile force, of the elastic member 500 may be smaller than a force corresponding to a sensed pressure of the fluid which is transmitted from the high-low pressure chamber 110A to the first fluid path 351 through the sensing port 102. When the sensed pressure is not transmitted to the first pressure portion 312, the elastic force is greater than the pressure of the first fluid path 351.

Accordingly, the stroke converting valve 310 performs a closing operation of blocking the third fluid path 353 by using the elastic force of the elastic member 500 which is greater than the fluid pressure transmitted through the first fluid path 351, and performs an open operation of connecting the third fluid path 353 to the control valve 320 by using the fluid pressure of the first fluid path 351 and the sensing port 102 corresponding to the fluid pressure of the high pressure chamber 110B.

The sensing fluid groove 151 is formed on an outer circumferential surface of the large diameter portion 152 and is concave in a radial direction thereof. The sensing fluid groove 151 is disposed above a middle portion of the piston 150 so that the fluid pressure is transmitted through the high pressure connecting path 340 and the sensing port 102 when the chisel 210 breaks the bedrock.

The return fluid groove 155 may be formed in a concave shape on the large diameter portion 152 in a longitudinal direction of the piston 150 and may have a length corresponding to an interval between the long stroke port 104 and the oil tank port 103. One end of the return fluid groove 155 is disposed at a same position as the oil tank port 101, and the other end of the return fluid groove 155 may be disposed on a same position as the long stroke port 104. Accordingly, when the piston 150 ascends and descends, the fluid, such as oil, may be returned to the oil tank port 103, and thus, when the piston 150 ascends from a bottom dead center, the above-described oil returning function operates to control the piston 150 to smoothly ascend.

According to the embodiment, the two-step auto stroke hydraulic breaker of FIG. 9 may have a simplified fluid flow structure.

Figure 10:
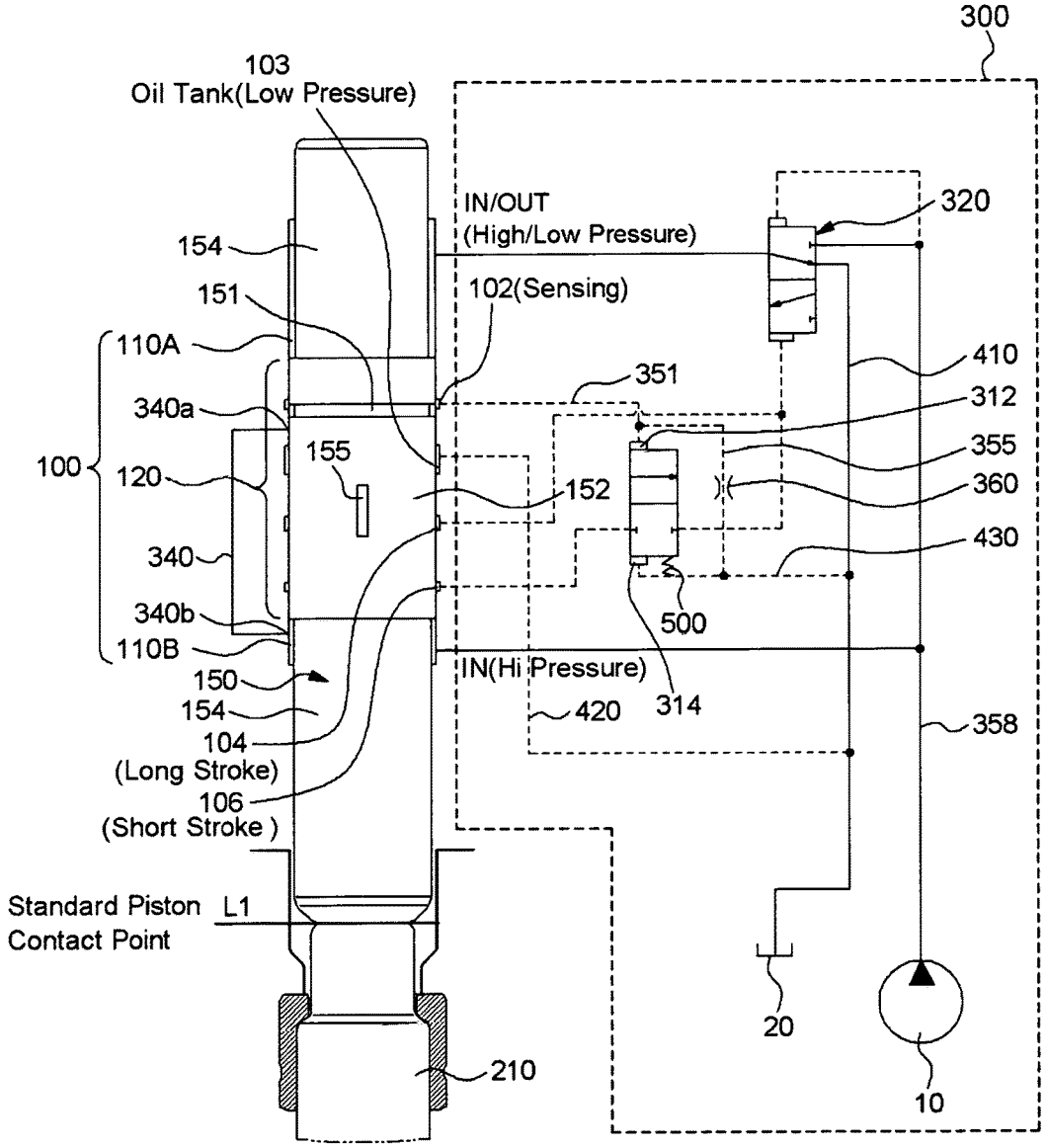
FIG. 10 is a fluid circuit diagram schematically illustrating a two-step auto stroke hydraulic breaker according to another embodiment.

FIG. 10 illustrates a two-step auto stroke hydraulic breaker according to another embodiment. The two-step auto stroke hydraulic breaker of FIG. 10 may not have the second fluid path 352 of FIG. 9.

Referring to FIGS. 1, 9, and 10, the two-step auto stroke hydraulic breaker may include the cylinder 150, which includes a high-low pressure chamber 110A at an upper portion thereof, a high pressure chamber 110B at a lower portion thereof, and a pressure converting chamber 120 having a pressure relatively lower than the high pressure chamber 110B and having the sensing port 102, the first connecting port 340*a*, the oil tank port 103, the long stroke port 104, and the short stroke port 106, the piston 150, which is movably coupled to a hollow inside of the cylinder 100 and includes the small diameter portion 154, the large diameter portion 152, and the sensing fluid groove 155 formed as a concave shape on the outer circumferential surface of the large diameter portion 152 of the piston 150, the return fluid groove 155, which is formed as a concave groove on the large diameter portion 152 in an axial direction of the piston 150, the high pressure connecting path 340, which supplies a fluid, i.e., hydraulic fluid or oil, from the high pressure chamber 110B to the sensing port 102, the fluid circuit unit 300, which controls a supply direction of the fluid supplied into an inside of the cylinder 100 and provides a pressure, i.e., fluid pressure, to selectively change a stroke according to a kind of a bedrock, and the chisel 210, which breaks the bedrock when a lower portion of the piston 150 descends to impact the chisel 210 during a descending operation of the piston 150.

The fluid circuit unit 300 may include a control valve 320, which is disposed between the cylinder 100 and the pump 10 to control a supply direction of the fluid, the stroke converting valve 310, which includes an upper portion connected to the first fluid path 351, which is a connecting path of the sensing port 102, and a lower portion connected to an elastic member 500 having an elastic force, for example, tensile force, relatively greater than a pressure of the fluid supplied to the first pressure portion 312 through the first fluid path 351, the fourth fluid path 354 which connects the long stroke port 104 and the control valve 320, the bypass fluid path 355 which connects the first fluid path 351 and the first return fluid path 410, and the orifice 380 which is disposed in the bypass fluid path 355.

The stroke converting valve 310 performs a closing operation of blocking the third fluid path 353 by using a sum of the elastic force of the elastic member 500 and a fluid pressure of a third, return fluid path 430, which becomes greater than the fluid pressure of the first pressure, portion 312 and the first fluid path 351, so that the long stroke is performed. When the piston 150 further descends by breaking the bedrock, the fluid pressure transmitted through the first fluid path 351 from the high-low pressure chamber 110A is transmitted to the first pressure portion 312 of the stroke converting valve 310 to connect the third fluid path 353 to the control valve 320, so that the stroke changing operation is stably performed to change the stroke from the long stroke to the short stroke.

The embodiment of FIG. 10 may be different from the embodiment of FIG. 1. That is, the embodiment of FIG. 10 may not include the pilot port 101 and the second fluid path 352, may supply the fluid pressure of the first fluid path 351 to the first pressure portion 312 of the stroke converting valve 310, and may further include the elastic member 500 and the third return fluid path 430 which are disposed opposite to the first pressure portion 312 of the stroke converting valve 310.

The stroke converting valve 310 performs a closing operation of blocking the third fluid path 353 by using a sum of the elastic force of the elastic member 500 and a fluid pressure of a third return fluid path 430, the sum being greater than the fluid pressure of the first fluid path 351, and performs an opening operation of connecting the third fluid path 353 to the control valve 320 when the fluid pressure of the high pressure chamber 110B is transmitted to the first fluid path 351 through the high pressure connecting path 340, the sensing fluid groove 151, and the sensing port 102.

The elastic member 500 provides the elastic force to a lower portion of the stroke converting valve 310, and the elastic force of the elastic member 500 is added to the fluid pressure of the third return fluid path 430. In a normal state (or the long stroke operation), the fluid of the high pressure chamber 110B is not supplied to the first pressure portion 312 of the stroke converting valve 310 through the first fluid path 351. That is, since the sum of the elastic force of the elastic member 500 and a residual fluid pressure of the third return fluid path 430 is used as a force to maintain a long stroke position of the stroke converting valve 310 in the normal state, the stroke is rapidly changed between the long stroke and the short stroke.

The sensing fluid groove 151 of FIG. 10 may be same as or similar to the sensing fluid groove 155 of FIG. 9. That is, the sensing fluid groove 151 is formed on an outer circumferential surface of the large diameter portion 152 and is concave in a radial direction thereof. The sensing fluid groove 151 is disposed above a middle portion of the piston 150 so that the fluid pressure is transmitted through the high pressure connecting path 340 and the sensing port 102 when the chisel 210 breaks the bedrock.

The return fluid groove 155 may be formed in a concave shape on the large diameter portion 152 in a longitudinal direction of the piston 150 and may have a length corresponding to an interval between the long stroke port 104 and the oil tank port 103. One end of the return fluid groove 155 is disposed at a same position as the oil tank port 101, and the other end of the return fluid groove 155 may be disposed on a same position as the long stroke port 104. Accordingly, when the piston 150 ascends and descends, the fluid, such as oil, may be returned to the oil tank port 103, and thus, when the piston 150 ascends from a bottom dead center, the above-described oil returning function operates to control the piston 150 to smoothly ascend.

According to the embodiment, the two-step auto stroke hydraulic breaker of FIG. 9 may have a simplified fluid flow structure.

As described above, the two-step auto stroke hydraulic breaker according to the present disclosure senses the strength of the bedrock, automatically changes the stroke of the piston.

It should be understood that embodiments described herein should be considered in a descriptive sense only and not for purposes of limitation. Descriptions of features or aspects within each embodiment should typically be considered as available for other similar features or aspects in other embodiments.

While one or more embodiments have been described with reference to the figures, it will be understood by those of ordinary skill in the art that various changes in form and details may be made therein without departing from the spirit and scope of the Inventive concept as defined by the following claims.

What is claimed is:

1. A two-step hydraulic breaker having a long stroke mode and a short stroke mode, comprising:

a cylinder including a high-low pressure chamber at an upper portion thereof, a high pressure chamber at a lower portion thereof, and a pressure converting chamber which is disposed between the high-low pressure chamber and the high pressure chamber and includes a pilot port, a high pressure connecting port connected to the high pressure chamber, a sensing port, an oil tank port, a long stroke port, and a short stroke port;

a piston movably disposed inside the cylinder to move along a longitudinal direction of the cylinder, and including small diameter portions corresponding to the high-low pressure chamber and the high pressure chamber, a large diameter portion disposed between the small diameter portions to correspond to the pressure converting chamber, the large diameter portion including upper and lower large diameter portions and a sensing fluid groove disposed between the upper and lower large diameter portions;

a fluid circuit unit configured to control a supply direction of the fluid to the cylinder, and to generate a fluid pressure to selectively change a stroke mode according to fluid pressures of the pilot port, the sensing port, the long stroke port, and the short stroke port; and a chisel configured to break a bedrock when a lower portion of the piston descends along a longitudinal direction of the piston to impact the chisel during a descending operation, wherein when the sensing fluid groove of the piston is disposed to connect a high pressure connecting port of the high pressure chamber of the cylinder to the sensing port of the cylinder, the upper large diameter portion of the piston is disposed to block the pilot port of the cylinder, and the lower large diameter portion of the piston is disposed to block the oil tank port, the long stroke port, and the short stroke port of the cylinder.

2. The hydraulic breaker of claim 1, wherein:

when the piston descends to move along the longitudinal direction of the piston while the hydraulic breaker is in the long stroke mode, the sensing fluid groove of the piston is not disposed to connect the high pressure connecting port of the high pressure chamber of the cylinder to the sensing port of the cylinder; and when the piston further descends to move along the longitudinal direction of the piston in the long stroke mode, the sensing fluid groove of the piston is disposed to connect the high pressure connecting port of the high pressure chamber of the cylinder to the sensing port of the cylinder such that the hydraulic breaker is to be in the short stroke mode.

3. The hydraulic breaker of claim 1, further comprising:

a return fluid groove being concave on the lower large diameter portion in a longitudinal direction of the piston to return the fluid to the oil tank port, wherein:

the sensing port, the high pressure connecting port, the oil tank port, the long stroke port, and the short stroke port are disposed below the pilot port; and a high pressure connecting path connected to the high pressure connecting port is configured to supply a fluid from the high pressure chamber to the sensing port through the sensing fluid groove when the chisel breaks the bedrock.

4. The hydraulic breaker of claim 1, wherein the fluid circuit unit comprises:

a control valve disposed on a plurality of fluid paths between the cylinder and a pump to control the supply direction of the fluid through the fluid paths;

a stroke converting valve including a first pressure portion connected to the sensing port through a first fluid path, a second pressure portion connected to the pilot port through a second fluid path having the fluid pressure higher than the fluid pressure of the first fluid path in a normal state, and selectively connecting the control valve and a third fluid path connected to the short stroke port of the cylinder;

a fourth fluid path configured to connect the long stroke port and the control valve;

a bypass fluid path configured to connect the first fluid path and the second fluid path; and an orifice disposed in the bypass fluid path.

5. The hydraulic breaker of claim 4, wherein:

a cross-section area of the first pressure portion of the stroke converting valve which is connected to the first fluid path is same as a cross-section area of the second pressure portion of the stroke converting valve which is connected to the second fluid path;

the stroke converting valve performs a closing operation of blocking the third fluid path by using the fluid pressure of the second fluid path greater than the fluid pressure of the first fluid path in the normal state; and the stroke converting valve performs an open operation of connecting the third fluid path to the control valve when the fluid pressure of the high pressure chamber is transmitted to the first fluid path through the high pressure connecting path, the sensing fluid groove, and the sending port.

6. The hydraulic breaker of claim 1, wherein the sensing fluid groove is concave in a radial direction of the large diameter portion along the outer circumferential surface of the large diameter portion of the piston, and is disposed above a middle portion of the piston so that the fluid pressure of the high pressure chamber is transmitted to the sensing port through a high pressure connecting path connected to the high pressure connecting port when the chisel breaks the bedrock.

7. The hydraulic breaker of claim 1, wherein:

the sensing port is disposed below the pilot port;

an oil tank port is disposed below the sensing port;

the long stroke port is disposed below the oil tank port; and the short stroke port is disposed below the long stroke port, along the longitudinal direction of the cylinder.

8. The hydraulic breaker of claim 1, wherein:

the oil tank port, the long stroke port, and the short stroke port are formed in an inside circumferential surface of the cylinder in order along the longitudinal direction of the cylinder; and cross-sections of the pilot port and the sensing port are respectively disposed on corresponding planes perpendicular to the hollow inside circumference surface of the cylinder.

9. The hydraulic breaker of claim 1, wherein, when the piston is at a contact point with the chisel:

the pilot port is sealed by the upper large diameter portion;

the sensing port is sealed by the lower large diameter portion; and the oil tank port, the long stroke port, and the short stroke port are sealed by the lower large diameter portion.

10. The hydraulic breaker of claim 1, wherein:

the return fluid groove of the piston has a length corresponding to an interval between the long stroke port and the oil tank port of the cylinder along the longitudinal direction of the piston; and when the return fluid groove of the piston includes one end disposed at a same height as the oil tank port of the cylinder, and the other end disposed at a same height as the long stroke port, so that the fluid is returned to the oil tank port from the long stroke port of the cylinder.

11. The hydraulic breaker of claim 1, wherein the sensing port, the oil tank port, the long stroke port, and the short stroke port are disposed below the pilot port in order along the longitudinal direction of the cylinder, and the pilot port is disposed between the high-low pressure chamber and the pressure converting chamber.

12. The hydraulic breaker of claim 1, wherein when the sensing fluid groove of the piston is disposed to correspond to the sensing port of the cylinder:

the fluid is transmitted from the high pressure chamber to the sensing port through the sensing fluid groove of the piston; and the fluid circuit unit is configured to change the stroke mode between the long stroke mode and the short stroke mode according to the fluid pressure of the sensing port.

13. The hydraulic breaker of claim 1, wherein the sensing fluid groove is disposed above a middle portion of the piston so that the fluid pressure is transmitted from the high pressure chamber to the sensing port through a high pressure connecting path when the chisel breaks the bedrock.

14. The hydraulic breaker of claim 1, further comprising a return fluid groove configured to be a concave shape on the lower large diameter portion in the longitudinal direction of the piston, and having a length corresponding to an interval between the long stroke port and the oil tank port to return the fluid to the oil tank port.

15. The hydraulic breaker of claim 1, wherein the piston further comprises a return fluid groove in the lower large diameter portion and having one end disposed to correspond to the oil tank pot and the other end disposed to correspond to the long stoke port when the piston ascends and descends along the longitudinal direction of the cylinder.

16. The hydraulic breaker of claim 1, wherein a minimum fluid pressure of the high-low pressure chamber is maintained higher than the fluid pressure of the pressure converting chamber in which the sensing port is disposed.

17. The hydraulic breaker of claim 1, wherein the fluid circuit unit controls the fluid pressures of the high-low pressure chamber, the long stroke port, and the short stroke port according to the fluid pressures of the pilot port and the sensing port.

18. The hydraulic breaker of claim 1, wherein the fluid circuit unit maintains the long stroke mode when the fluid pressure of the pilot port is higher than the fluid pressure of the sensing port, and converts the long stroke mode and the short stroke mode according to the fluid pressure of the sensing port.

19. The hydraulic breaker of claim 1, wherein the small diameter portions comprise an upper small diameter portion and a lower small diameter portion, the lower small diameter portion of the piston moves to selectively correspond to the high pressure chamber and the long stroke port in the long stroke mode and to selectively correspond to the high pressure chamber and the short stroke port in the short stroke mode.

20. The hydraulic breaker of claim 1, wherein:

when the sensing fluid groove of the piston is disposed to connect the fluid of the high pressure chamber to the sensing port in a sensing mode, the pilot port is disposed above the sensing fluid groove and corresponds to the upper large diameter portion of the piston, and the oil tank port, the long stroke port and the shot stroke port are disposed below the sensing fluid groove and correspond to the lower large diameter portion of the piston, along the longitudinal direction of the cylinder.

* * * * *